US011457779B2

(12) United States Patent
Dill et al.

(10) Patent No.: US 11,457,779 B2
(45) Date of Patent: Oct. 4, 2022

(54) FOOTREST FOR SUPPORTING A SQUATTING POSITION

(71) Applicants: Dieter Roman Dill, Berlin (DE); Oliver Dill, Basel (DE)

(72) Inventors: Dieter Roman Dill, Berlin (DE); Oliver Dill, Basel (DE)

( * ) Notice: Subject to any disclaimer, the term of this patent is extended or adjusted under 35 U.S.C. 154(b) by 56 days.

(21) Appl. No.: 16/770,604

(22) PCT Filed: Dec. 6, 2018

(86) PCT No.: PCT/EP2018/083895
§ 371 (c)(1),
(2) Date: Jun. 7, 2020

(87) PCT Pub. No.: WO2019/110772
PCT Pub. Date: Jun. 13, 2019

(65) Prior Publication Data

US 2020/0323404 A1 Oct. 15, 2020

(30) Foreign Application Priority Data

Dec. 6, 2017 (EP) ..... 17205744

(51) Int. Cl.
*A47K 17/02* (2006.01)
*A47C 16/02* (2006.01)
*A47K 17/00* (2006.01)

(52) U.S. Cl.
CPC ..... *A47K 17/028* (2013.01); *A47C 16/02* (2013.01); *A47K 2017/006* (2013.01)

(58) Field of Classification Search
CPC ..... A47K 17/028; A47K 2017/006; A47C 16/02; A47C 16/00
USPC ..... 4/254; 297/423.41
See application file for complete search history.

(56) References Cited

U.S. PATENT DOCUMENTS

| | | | | |
|---|---|---|---|---|
| 2,023,901 | A * | 12/1935 | Rhodes | A47K 17/028 4/254 |
| 5,028,024 | A * | 7/1991 | Welles | A47K 17/028 248/163.1 |
| 8,607,369 | B1 * | 12/2013 | Al-Khattaf | A47K 17/02 4/254 |
| D738,126 | S * | 9/2015 | Edwards | D6/349 |
| D802,311 | S * | 11/2017 | Stricklin | D6/349 |
| 10,694,859 | B1 * | 6/2020 | Wickland | A47C 4/045 |
| 2011/0193392 | A1 * | 8/2011 | Gane | B60N 3/06 297/423.4 |
| 2014/0123376 | A1 * | 5/2014 | Edwards | A47K 17/028 4/254 |
| 2015/0272410 | A1 | 10/2015 | Lavassani | |

(Continued)

FOREIGN PATENT DOCUMENTS

| | | |
|---|---|---|
| AU | 2573688 A | 8/1989 |
| KR | 200355599 | 7/2004 |

*Primary Examiner* — Benjamin R Shaw
(74) *Attorney, Agent, or Firm* — JMB Davis Ben-David

(57) ABSTRACT

The invention relates to a footrest designed to support a squatting position during seated-position toilet use. The footrest is comprising two base sections B and B' that are, under normal conditions of use, in contact with a supporting surface and two foot-support sections S and S' adjacent to said base sections. S and S' have an outer surface curved downwards in the longitudinal extension direction towards said base sections B and B'.

19 Claims, 16 Drawing Sheets

(56) References Cited

U.S. PATENT DOCUMENTS

| | | | | |
|---|---|---|---|---|
| 2015/0327739 | A1* | 11/2015 | Edwards | A47C 9/105<br>4/254 |
| 2017/0027331 | A1* | 2/2017 | Jensen | A47K 17/028 |
| 2019/0150682 | A1* | 5/2019 | Nethercott | A47K 17/028 |
| 2021/0244584 | A1* | 8/2021 | Masters | A61G 5/14 |

* cited by examiner

A)

B)

FOOTREST FOR SUPPORTING A SQUATTING POSITION

CROSS-REFERENCE TO RELATED APPLICATIONS

This is the U.S. National Stage of International Patent Application No. PCT/EP2018/083895 filed on Dec. 6, 2018, which claims priority to European Patent Application No. 17205744.0 filed on Dec. 6, 2017.

The present invention relates to a footrest designed to provide an optimal squatting position during seated-position toilet use and its use.

BACKGROUND

Humans have always used the squatting posture for resting, working and performing bodily functions. In a squatting position the backside is placed on the heels with the knees maximally bend, while the thighs are spread apart. In this traditional squatting position, the lower gastrointestinal tract is vertically aligned so that the passage resistance is minimized, and the gravity pull is maximized. Further, the squatting position leads to a better utilization of the abdominal muscles and reduced strain on the sphincter muscles. The pelvis floor muscles, in particular the puborectalis muscle, are relaxed which normally seals the rectum in order to maintain continence.

The users of western-style toilets are usually seated in a chair-like sitting position, where hip, knees and ankles are locked in 90-degree angles, which represents a significant departure from the squatting position. In the sitting position, the lower gastrointestinal tract is bent at an almost right angle to the rectum at rest and increases during defecation due to the unfavourable angle against the puborectalis muscle. Therefore, the puborectalis muscle creates a kink in the passageway of bowel contents.

Hence to empty the bowel, strain has to be applied frequently. Chronic straining on the toilet and as a result the partial evacuation of the bowels can cause several diseases ranging from hemorrhoidal disease to even hernia. In particular haemorrhoids, constipation, appendicitis, anal fissure, intestinal polyps, irritable colon, inflammation of the colon, diverticulosis, colonic cancer, urinary incontinence, prostate complaints, varicose veins, apoplectic stroke, and even cardiac infarction are among the caused diseases. Hence, sitting toilets are physiologically unnatural and ill-suited for defecation.

Even though the traditional squatting position is physiologically the optimal position, the chair-like sitting toilet has replaced the squatting toilet in most countries nowadays. Advantages of this type of toilet is the perceived comfort as well as conditions that make it difficult to achieve a squatting position such as obesity, knee problems or frailty. The vast majority of people living in the Western World are used to conventional sitting toilets and lack the flexibility and required strength to adopt the full squat position for any length of time unaided.

Until conventional western-style toilets are replaced by devices that allow for a more physiological position, a need exists for an inexpensive and practical solution for supporting a user's body in a physiological posture facilitating bowel elimination during seated-position toilet use.

WO 2017/178873 A1 disclosed a sitting toilet assembly with various foot and thigh supporters to achieve such a position. However, this teaching requires the replacement of the whole toilet system and does not provide an inexpensive solution. Furthermore, this toilet assembly does not allow the user to adjust the opening angle of the knees to a position comfortable for the user and relaxing to the muscles of the pelvic floor.

The solution provided by US 2013/0174337 A1 is a foot support that provides an inexpensive solution to support a squatting position for the user. However, the foot support does only allow to adjust the resting position of the feet in a vertical direction. The device does not support different opening angles of the knees.

Based on the above-mentioned state of the art, the objective of the present invention is to provide means and methods to provide an inexpensive device to support an optimal squatting position during seated-position toilet use. This objective is attained by the claims of the present specification.

SPECIFIC DESCRIPTION

A first aspect of the invention relates to a footrest designed to support a squatting position during seated-position toilet use. The footrest is comprising two base sections B and B' that are, under normal conditions of use, in contact with a supporting surface and two foot-support sections S and S' adjacent to the base sections.

The footrest is characterized in that S and S' have an outer surface that is at least partially inclined downwards in the longitudinal extension direction towards the base sections B and B'.

The longitudinal extension direction runs from the base section B towards foot support sections S and S' and then towards base section B' and represents therefore the length of the foot rest. The shape of a surface inclined downwards includes all shapes that have in common that the surface has an inclination angle in the downward direction, defined by the tangent of the surface and the supporting surface, that is not 0°. This would include without being limited to, shapes with a straight linear decrease, a circular cross-section, or other types of curvature. A surface inclined downwards at least partially includes surfaces that have parts that are horizontal and other parts that have an inclination angle and/or a curvature.

The term squatting position in the context of the present specification relates to a position where the knees and hips are bent. The angle between the thighs and the upper body is usually between 25° and 45°.

Under normal conditions of use with the user being in a seated-position on a toilet, the feet are resting on the foot-support sections of the footrest. The outer (=upper) surface of the foot-support section is not horizontal but inclined downwards toward the outer ends of the footrest. This allows a more physiological position of the feet if the thighs of the user are not parallel but in a more open angle. This more open position of the thighs results in relaxation of the muscles in the pelvic floor and the hips and reduces the strain during defaecation. Spreading of the thighs does either require to place the feet further apart, which is difficult unless the user partially undresses, or to place the feet not on their sole but their external side. Placing the feet further apart would require a footrest of greater dimensions and to rest the feet on their external side is neither comfortable nor can many people hold such a position for a long time. As most people tend to choose the most comfortable position, a horizontal surface would not encourage them to spread the thighs into this more physiologic position. In contrast an inclined surface allows the user to place the feet comfortably on their sole without having to place the feet further apart and require a footrest of greater dimension or to undress, both of which are impractical. Such a placement of the feet on their sole further contributes to a comfortable and relaxing position, by having most of the user's weight placed on the heels. An advantageous opening angle between the thighs to relax the musculature of the pelvic floor would be between 30° and 120°.

Another advantage of the downward inclined surface is that it allows for users of different sizes to find a comfortable squatting position, with smaller users placing the feet closer to the centre of the footrest and larger users placing their feet more to the outside of the footrest.

Yet another advantage concerns an increase in lateral stability for the user. The placement of the feet on the whole of the sole and not on the outside of the feet provides more stability against unwanted sideward movement. This is particular important for incapacitated or frail people.

In consequence by elevating the knees and supporting a position with spread thighs the footrest of the current invention supports a position very close to the natural squatting position. In particular spreading of the thighs, encouraged by the inclined surface, increases the relaxation of the musculature in the pelvic floor and the hips and therefore represents a better position for the user with less strain.

Another advantage of such a footrest would be that it can be easily stored. The footrest can be tilted by 90° to rest on its side (=storage position) and is then easily stored around the base of the toilet seat. The footrests known in the art usually comprise a recess in the middle of the foot support area to allow the storage of the footrest, at least partially, underneath the toilet. However, the design of toilet seats has changed over the last decade with toilets having an increasingly broader and steeper forward end. This is mainly due to hygienic reasons since shapes with a more rounded broader end minimize the scattering spray of urine. A toilet of such a broader shape will not accommodate footrests with a recess, since the recess would have to be as broad as the toilet base, which would not leave much area for foot-support. The footrest of the present invention however, does allow easy storage with hardly any space requirements by tilting the footrest by 90 degrees and storing it around the base of the toilet. The footrest can be stored around the front or the side of the base of the toilet. Exemplary embodiments of storage positions are shown in FIG. 13. This storage position also makes it possible to store a footrest with a much larger upper surface and wider dimensions as the footrest in the art with the storage recess.

In certain embodiments, the outer surface of foot-support sections S and S' are entirely inclined downwards in the longitudinal extension direction towards said base sections B and B'.

In certain embodiments, the inclined surface of the foot-support sections S and S' have independently from each other in the longitudinal extension direction towards the base sections B or B' a maximal longitudinal inclination angle that is between 5° and 20°. In certain embodiments, the longitudinal inclination angle is between 8° and 16°. The inclined surface of the foot-support sections S and S' do not have to be necessarily identical. In certain embodiments, they are different. The longitudinal inclination angle is defined by a tangent to the outer surface of the foot support sections in the longitudinal extension direction and the plane of the supporting surface of the footrest under normal conditions of use.

In certain embodiments, the inclined surface of the foot-support sections S and S' have independently from each other in the longitudinal extension direction towards the base sections B or B' no curvature and a maximal longitudinal inclination angle that is between 5° and 20°. In certain embodiments, without curvature of the outer surface of the foot support sections the longitudinal inclination angle is between 8° and 16°.

In certain embodiments, the outer surfaces of foot-support sections S and S' are curved downwards in the longitudinal extension direction towards the base sections B and B'.

The term curved in the context of the present invention relates to a geometric object that is characterized by a curvature. A curvature signifies the amount by which a geometric object, such as a surface or curve, deviates from being a flat surface (curvature=0) or straight line (curvature=0). The curvature of a circle is defined by its radius and is the reciprocal value of its radius (1/r).

The downward curved surface, in particular shapes that resemble at least partially a circular cross-section, is suited to the physiology of the knee and hip joints. This enables in the squatting position, in particular with spread thighs, to place the feet always on their whole sole independent of the spreading angle of the thighs. This results in a more comfortable position for the use.

Yet another advantage of the footrest is the structural stability inherent to this kind of downward curved shape. Advantages of the increased stability is the reduction in material needed to produce such a footrest, which results in a decrease in costs and a decrease in weight. The decreased weight is advantageous for handling of the footrest, in particular for elderly people.

Another advantage inherent to the shape and its high structural stability is that no reinforcing elements are required, which are present in footrests with a horizontal upper surface. Eliminating reinforcing elements and tight corners is very advantageous to improve hygiene. Open surfaces without corners shaped by reinforcing elements are much easier to clean. Given the area of use being in a sanitary environment, improved hygiene is an advantageous property.

In certain embodiments, the minimal curvature of the downwards curved outer surfaces of foot-support sections S and S' in the longitudinal extension direction is characterized by an osculating circle with a radius of 0.1 cm to 12 cm, in particular 2 cm to 8 cm.

In the context of the present invention, wherein the shape of a surface along a certain direction (e.g. longitudinal extension direction) is addressed this refers to the shape of a cross-section of the surface along the given direction. Therefore, the shape of a surface along a given direction can be described by means used to define plane curves.

The curvature of a plane curve can be defined by using osculating circles. The term osculating circle is used in its meaning known in the fields of mathematics and geometry and relates to a circle that is in contact with a given point on a curve and its curvature is the same as that of the given curve at that point. The curvature of a circle is equal to the reciprocal value of the radius of the circle (1/r). The radius of an osculating circle, also referred to as the radius curvature, therefore determines the curvature of a plane curve at the point of contact between curve and osculating circle.

The maximal curvature of the downwards curved outer surfaces of foot-support sections S and S' in the longitudinal extension direction is equal to the maximal curvature of the cross section through foot-support sections S and S' in the longitudinal extension direction with the highest curvature.

In certain embodiments, the downwards curved outer surfaces of foot-support sections S and S' in a longitudinal extension direction towards the base sections B or B' are independently of each other defined by their cross-sections. These cross-sections, in particular their curvature, are defined by osculating circles with a decreasing radius with the smallest radius being at the transition from the foot support sections S and S' to the base sections B or B'. In other words, the osculating circle describing the cross-section of the outer surface of the foot support sections next to the point of contact between the foot support sections has the largest radius. The next point in the curve of the cross-section towards the base section is described by an osculating circle with a smaller radius. The radius of the osculating circles along the longitudinal extension direction towards the base section continues to decrease until the point of maximal curvature (=smallest radius) is reached. This point is the transition between the foot support section and the base section.

In certain embodiments, the downwards curved surface of the foot-support sections S and S' are defined by two or more circular segments connected to each other in longitudinal extension direction (FIG. 20).

In certain embodiments, the downwards curved surface of the foot-support sections S and S' have independently from each other in the longitudinal extension direction towards the base sections B or B' a maximal nominal longitudinal inclination angle that is between 5° and 20°. In certain embodiments, the maximal nominal longitudinal inclination angle is between 8° and 16°.

The nominal inclination angle of the downwards curved surface in the context of the present invention refers to the angle defined by the plane of the supporting surface and a tangent of the osculating circle that defines the maximal curvature of the downwards curved surface, wherein the tangent crosses the point of contact between both foot support sections (FIGS. 2 and 4). An example of a nominal inclination angle of 14° is shown in the embodiment of FIG. 4. In case of a connecting section in between both foot support sections the first tangent is defined by the point of contact between the foot support section and the connecting section. In case of a connecting section in between both foot support sections the tangent crosses the point of contact between the foot support section and the connecting section.

In certain embodiments, a first tangent to the point of contact between both foot support sections and the plane of the supporting surface define an angle of up to 12°.

In certain embodiments, a first tangent to the point of contact between both foot support sections and the supporting surface define an angle of 3° to 9°.

In certain embodiments, a second tangent to the end of the base section and the support surface define an angle of 15° to 80°.

In certain embodiments, a second tangent to the end of the base section and the support surface define an angle of 25° to 50°.

In certain embodiments, the downwards curved surface of the foot-support sections S and S' in a longitudinal extension direction towards the base sections B or B' is independently from each other defined by a hyperbolic function curve.

In the context of the present invention, wherein the shape of a surface along a certain direction (e.g. longitudinal extension direction) is addressed this refers to the shape of a cross-section of the surface along the given direction. Therefore, can the shape of a surface along a given direction be described by means used to define plane curves.

A hyperbolic function curve is a type of smooth curve lying in a plane defined by formula (1):

$$\frac{x^2}{a^2} - \frac{y^2}{b^2} = 1. \tag{1}$$

A hyperbola has two branches that are mirror images of each other. The hyperbolic function curve in the context of the present invention is referring to only one branch of the hyperbola. In formula (1) a and b can be any real number. The term real number is used in its meaning known from the field of mathematics. The variable a determines the distance of the vertices of the hyperbolic function and variable b determines the curvature of the hyperbolic function. Examples for different curvatures of a hyperbolic function in dependence of variable b is provided in FIG. 6. The shape of the surface with an inclination of a hyperbolic function represents in certain embodiments only a part of the hyperbolic function. In certain embodiments, it represents only a part of one branch. In certain embodiments, it represents only a part of one branch without including the vertex of the hyperbolic function.

In certain embodiments, the hyperbolic function curve has a maximal inclination angle between 50° and 105°. In certain embodiments, the hyperbolic function curve has a maximal inclination angle between 60° and 90°. In certain embodiments, the hyperbolic function curve has a maximal inclination angle between 65° and 75°.

The maximal inclination angle is measured under normal conditions of use with the base sections being in contact with the supporting surface. The maximal inclination angle is defined by the tangent to the point of the hyperbolic function curve with the maximal inclination angle (vertex) and the supporting surface (see FIG. 7).

In certain embodiments, the maximal inclination angle of the downwards curved surface of the foot support sections S and S' in a longitudinal extension direction is between 50° and 105°. An inclination angle of 90° signifies a curve that is perpendicular to the supporting surface In certain embodiments, the maximal inclination angle of the downwards curved surface of the foot support sections S and S' in a longitudinal extension direction is between 60° and 90°. In certain embodiments, the maximal inclination angle of the downwards curved surface of the foot support sections S and S' in a longitudinal extension direction is between 65° and 75°.

In certain embodiments, the outer surfaces of the base sections B and B' are curved.

In certain embodiments, the outer surfaces of the base sections B and B' in a longitudinal extension direction towards the end of the base sections are independently of each other defined by osculating circles with an increasing radius with the smallest radius being at the transition from the foot support sections S and S' to the base sections B or B' (FIG. 5B).

In certain embodiments, the footrest is having in the transverse extension direction a maximal transverse inclination angle of up to 10°. In certain embodiments, the footrest is having in the transverse extension direction a transverse inclination angle of 3° to 10°. In certain embodiments, the footrest is having in the transverse extension direction a transverse inclination angle of 5° to 8°. The transverse inclination angle is defined by a tangent to the outer surface of the foot support sections in the transverse extension direction and the plane of the supporting surface of the footrest under normal conditions of use. The transverse extension direction is at a right angle to the longitudinal extension direction defined above and represents the width of the footrest.

In certain embodiments, the transverse inclination angle is constant along the transverse extension direction, with a maximal transverse inclination angle of up to 10°.

In certain embodiments, the transverse inclination angle is variable along the transverse extension direction, with a maximal transverse inclination angle of 3° to 10°.

In certain embodiments, the transverse inclination angle is variable along the transverse extension direction, with a maximal transverse inclination angle of 5° to 8°.

In certain embodiments, the transverse inclination angle is variable along the transverse extension direction, and the shape of the outer surface in the transverse extension direction is that of a curve. The highest point of the curve is at the starting- or ending-point of the curve. A footrest of this shape makes the footrest nestable with other footrests of the invention. This reduces the storage space required for a multitude of footrests significantly.

In certain embodiments, the transverse inclination angle is variable along the transverse extension direction, and the shape of the outer surface in the transverse extension direction is that of a curve with the highest point of the curve being in between the start and endpoint of the curve In certain embodiments, the footrest is having in the transverse direction an inclination of a hyperbolic function curve.

In certain embodiments, the footrest is having a length at the end of the base sections that are under normal conditions of use in contact with a supporting surface that is smaller than a length at the end of said foot support sections adjacent to said base sections. The length of the footrest is measured in the direction of its longitudinal extension direction and may be different in different cross-sections of the footrest. A non-limiting example would be if the base sections are curved inwards with the footrest resembling the shape of a U with the limbs tilted towards each other. In such a case the length of the footrest at the point of transition between the foot-support section and the base section would be larger than at the end of the base section that is in contact with the supporting surface under normal conditions of use. The shape of this embodiment increases the structural stability of the footrest even further. Furthermore, does such a shape require even less space for storage since the base sections would bend around the base of the toilet in the 90 degrees tilted storage position. In certain embodiments, the length is smaller than the length by 1 cm to 10 cm. In certain embodiments, the length is smaller than the length by 2 cm to 8 cm.

In certain embodiments, the base sections B and B' have an outer surface that is curved in the transverse extension direction.

In certain embodiments, the base sections B and B' have an outer surface that is curved in the transverse extension direction, wherein the vertex of the curve is between the start- and endpoint of the curve.

In certain embodiments, the base sections B and B' have an outer surface that is curved in the transverse extension direction, wherein the vertex of the curve is at the start- or endpoint of the curve.

In the context of the present invention the term vertex is used in its meaning in the field of mathematics and geometry. A vertex is a point of a curve with a local maximum or minimum.

In certain embodiments, the end of the base sections that are under normal conditions of use in contact with a supporting surface have a width smaller than the maximal width of the footrest. The width of the footrest is measured in the direction of the transverse extension direction. A non-limiting example of such a footrest would be if the base sections have tapered ends that are narrower at their end that is in contact with the support surface than on the opposite end.

In certain embodiments, under normal conditions of use the end of the base sections are not in contact with the support surface over the whole width of the base section, but only in two or three sections. In certain embodiments, only two sections of the end of the base section is in contact with the support surface. Footrests according to this embodiment would have a significantly reduced contact area between the base section and the supporting surface. The reduced contact area has an advantage on wet surfaces since this would minimize the risk that liquids can soak into the material of the footrest. Independent of the material used this is also beneficial for hygienic reason since a potential contamination on the support surface would only be in contact with the footrest in a significantly reduced area.

In certain embodiments, B and S are symmetrical to B' and S'. In certain embodiments, B and S are mirror-symmetrical to B' and S' in relation to a plane extending in a transverse direction between S and S'.

In certain embodiments, the footrest is comprising an additional connecting section C that links the foot-support sections S and S'. The footrest contains a connecting section that is located between S and S'. Such a connecting section can be shaped differently from the foot-support sections including without being limited to curved sections that are elevated or lowered in relation to the foot-support sections. Suitable shapes can also include sections with a width smaller or larger than the foot-support sections.

In certain embodiments, the outer surface of the connecting section is curved downwards from the center of the connecting section. In other words, the connecting section has at its highest point in the geometric center and the outer surface is curved downwards in both directions towards the foot support sections.

In certain embodiments, the downward curved surface of the connecting section is defined by a tangent to the point next to the center that has an inclination angle of up to 12°. In certain embodiments the inclination angle is between 3° and 9°. The inclination angle is defined by the tangent and the supporting surface.

In certain embodiments, the footrest is in a two-part form with the parts being detachably connected along a division line in the longitudinal extension direction. A two-part footrest has the advantage that the divided parts can be pushed into each other (FIG. 17 B, D) and require therefore less storage space. In certain embodiments, the two parts of the footrest are joined by a tongue and groove joint. In certain embodiments, the tongue of the tongue and groove joint is wedge-shaped. This provides in addition to the form-closure of the tongue and groove joint a force closure by the parts being wedged together. In certain embodiments, the two parts of the footrest are configured at their line of division to provide a joint comprising two mirror symmetrical parts that have an overlapping section that is thinner than the material of the respective section. The division line may have an undulating shape to provide a more stable connection between the two parts. The end-part of the overlapping section is thicker than the middle part of the overlapping section. If the two sections are joined the thicker section of the end achieves a form-closure with the thinner part of the opposite section (FIG. 19).

In certain embodiments, the line of division in the longitudinal extension direction is not a straight line but a curved or undulated line. Such a line of division provides a joint with more stability under load due to a favourable wedging of the parts under load. Such a line of division is particularly useful if provided in connection with the above described tongue and groove joints.

In certain embodiments, the footrest is made of wood. Wood is an advantageous material for the footrest of the current invention due to beneficial hygienic properties. Wood has antibacterial properties and is therefore less prone to contamination than other materials.

In certain embodiments, the footrest is made of a single piece of wood. Manufacturing the footrest from a single piece of wood, in particular by bending a piece of wood into the desired shape, is advantageous because this provides more structural stability than using several pieces that have to be attached to each other. Furthermore, the aesthetic appearance of such a single piece footrest is superior.

In certain embodiments, the length of the footrest is 40 cm to 62 cm. In certain embodiments, the length of the footrest is 46 cm to 56 cm. In certain embodiments, the length of the footrest is 48 cm to 53 cm. The length of the footrest is measured along the longitudinal extension direction.

In certain embodiments, the maximal height of the footrest is 15 cm to 30 cm. In certain embodiments, the height of the footrest is 16 cm to 28 cm. In certain embodiments, the height of the footrest is 18 cm to 24 cm. The height of the footrest is measured in the position according to the normal condition of use, with both endings of the base section in contact with the supporting surface. The optimal height is i.e. dependant on the height of the toilet seat and the size of the user. The higher the knees are placed the smaller the angle between thighs and upper body is. The skilled person therefore can easily determine the optimal height to achieve the desired angle.

In certain embodiments, the width of the footrest is 15 cm to 30 cm. In certain embodiments, the width of the footrest is 16 cm to 28 cm. In certain embodiments, the width of the footrest is 18 cm to 24 cm. The width of the footrest is measured along the transverse extension direction.

In certain embodiments, the foot-support section S has at least two subsections S1 and S2; and the foot-support section S' has at least two subsections S'1 and S'2. S2 is being adjacent to the base sections B and S'2 is being adjacent to the base sections B'. The subsections S1 and S2 or S'1 and S'2 have a different longitudinal inclination from each other. The longitudinal inclination of the subsections may be between 3° and 25° or follow a curve, in particular a hyperbolic function curve.

In certain embodiments, the base section B has at least two subsections B1 and B2; and the base section B' has at least two subsections B'1 and B'2. B1 and B'1 are being adjacent to the foot-support sections S and S' and the subsections B1 and B2 or B'1 and B'2 have a different longitudinal inclination from each other. The longitudinal inclination of the subsections may be between 3° and 25° or follow a curve, in particular a hyperbolic function curve.

In certain embodiments, at least two sections selected from S, S', B or B' have on their side a protrusion. These protrusions are shaped in a way that in case the footrest is resting on its side only the protrusions are in direct contact with the supporting surface. In other words, if the footrest is tilted by 90 degrees from the position under normal conditions of use the only contact areas to the supporting surface are the protrusions. In certain embodiments, the footrest has three protrusions. In certain embodiments, each base section has one protrusion and one protrusion is located at the border between the two foot-support sections shaped to provide a secure standing position for the footrest on its side.

In certain embodiments, the foot-support sections do not contain a level section but have a downward curved surface starting at their contact point with each other, wherein the initial longitudinal inclination angle is between 2° and 8° and is increasing in the longitudinal extension direction. In certain embodiments the initial longitudinal inclination angle is between 3° and 6°. In certain embodiments the increase of the longitudinal inclination angle follows a hyperbolic function curve.

In certain embodiments, the transverse inclination angle is decreasing from the centre of the footrest in both directions towards both sides of the footrest. In other words, the highest point of the footrest is in between both sides of the footrest and is decreasing towards both sides.

A second aspect of the invention relates to the use of the footrest (100) according to the first aspect of the invention to support a squatting position during seated-position toilet use The invention is further illustrated by the following examples and figures, from which further embodiments and advantages can be drawn. These examples are meant to illustrate the invention but not to limit its scope.

Figure 1:
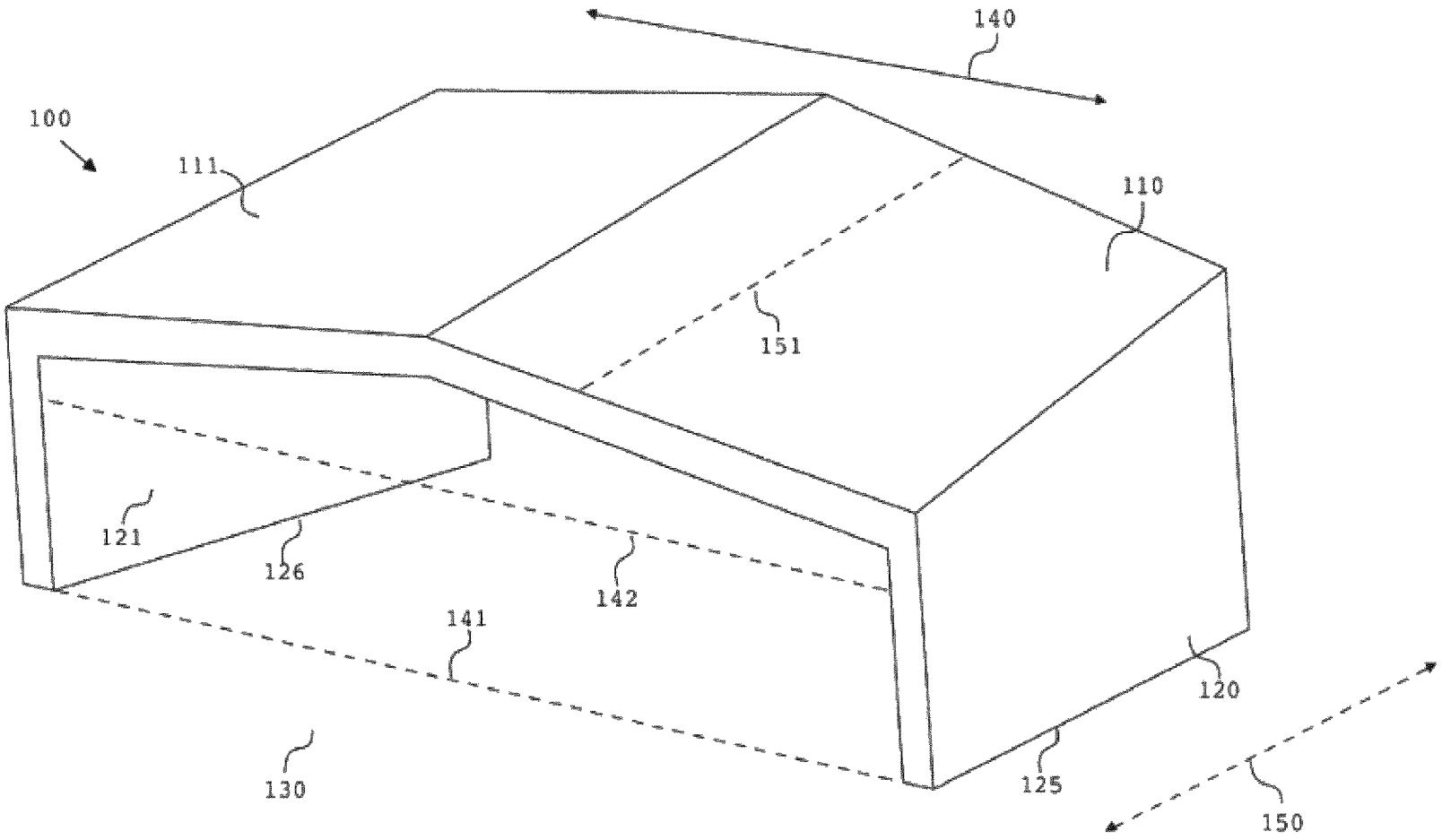
FIG. 1 shows an embodiment of the footrest (100) with the outer surface of the foot support sections S (110) and S' (111) inclined downwards symmetrically in the longitudinal extension (140) direction with a constant inclination angle. The base sections B (120) and B' (121) are perpendicular to the plane of the supporting surface (130) and are under normal conditions of use in contact with the supporting surface at their lower ends (125, 126). The length (141) is identical to the length (142). The width (151) of the footrest is identical along the longitudinal extension direction (140).
Figure 2:
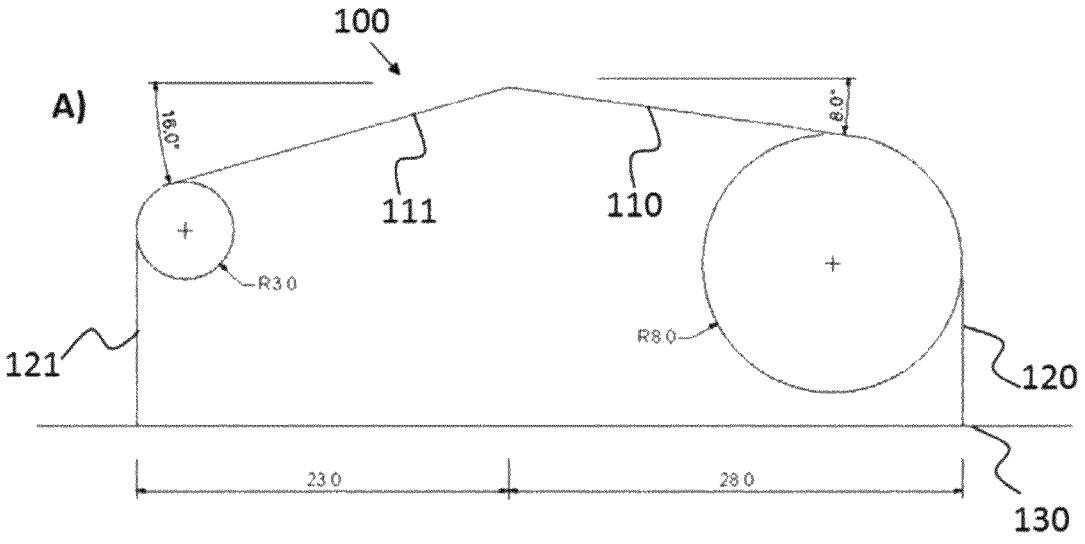
FIG. 2 shows an embodiment of the footrest (100) wherein the outer surface of the foot support sections S (110) and S' (111) are curved downwards. The maximal curvature is determined by the osculating circles A) with a radius of 8 cm (R8.0; right circle) or 3 cm (R3.0; left circle) or B) with a radius of 9 cm (R9.0; right circle) or 0.1 cm (R0.1; left circle).
Figure 2:
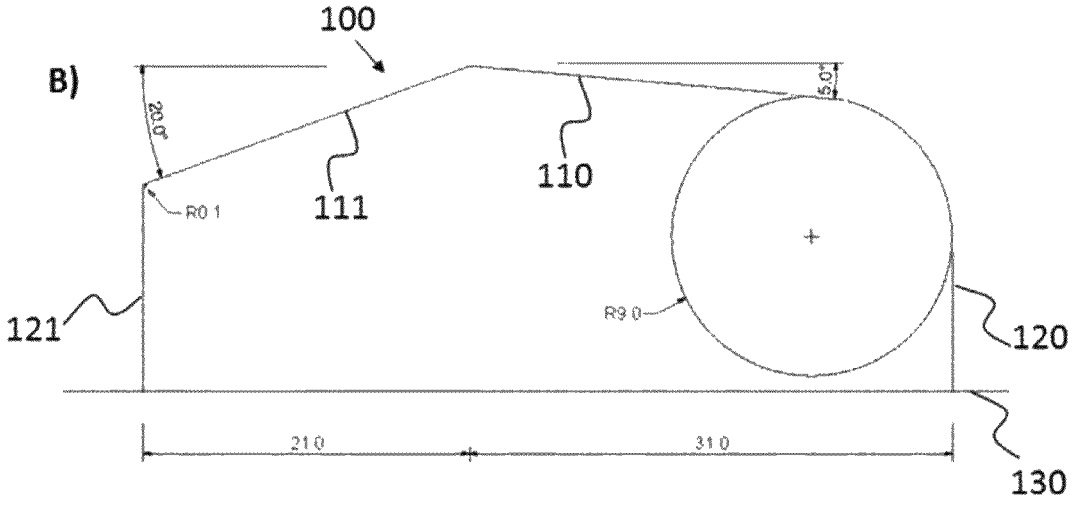
Figure 3:
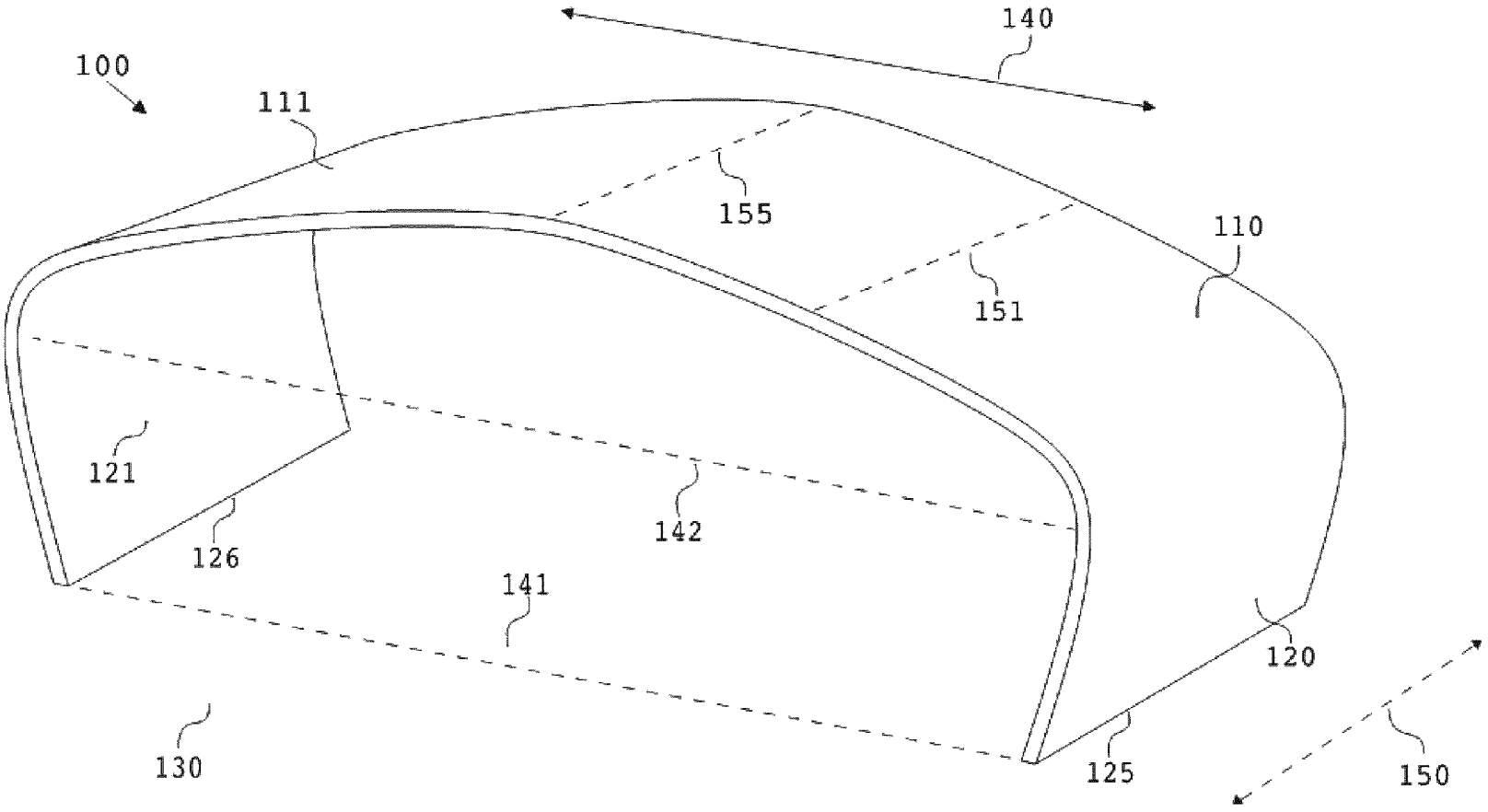
FIG. 3 shows an embodiment of the (100) footrest with an outer surface of the foot support sections S (110) and S' (111) in a downwards curved shape. The footrest is symmetrical across the center line (155). The base sections B (120) and B' (121) are also curved inwards with a length (141) being smaller than the length (142).
Figure 4:
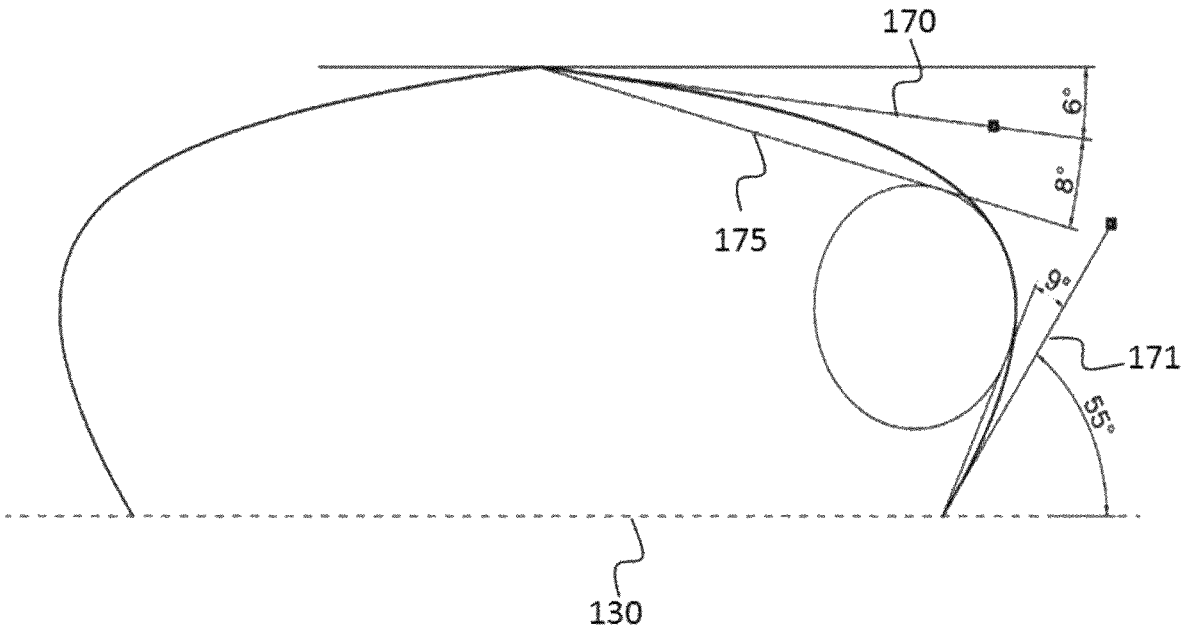
FIG. 4 shows an embodiment of the footrest (100) with a downwards curved outer surface of the foot support sections S (110) and S' (111). The nominal inclination angle is defined by the straight line (175) and the plane of the supporting surface (130). In this embodiment the nominal inclination angle is 14°. An angle defined by the first tangent (170) and the plane of the supporting surface (130) is 6° in this embodiment. The second tangent (171) and the plane of the supporting surface (130) define an angle of 55° in this embodiment.
Figure 5:
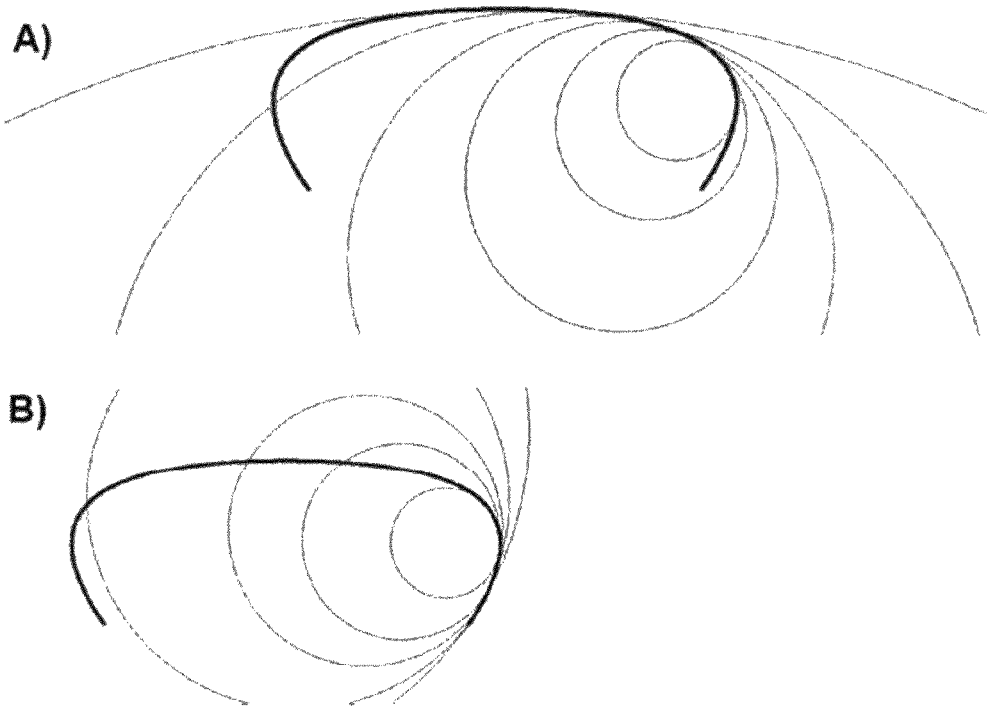
FIG. 5 shows an embodiment of the footrest (100) wherein A) the downwards curved outer surface of the foot support sections S (110) and S' (111) are defined by osculating circles with decreasing radius along the longitudinal extension direction (140) towards the base sections. The osculating circle with the smallest radius signifies the transition from the foot support sections S (110) and S' (111) to the base sections B (120) or B' (121). B) The base sections B (120) and B' (121) are curved inwards and are defined by osculating circles with increasing radius along the longitudinal extension direction (140) starting from the transition of the foot support sections to the base sections.
Figure 6:
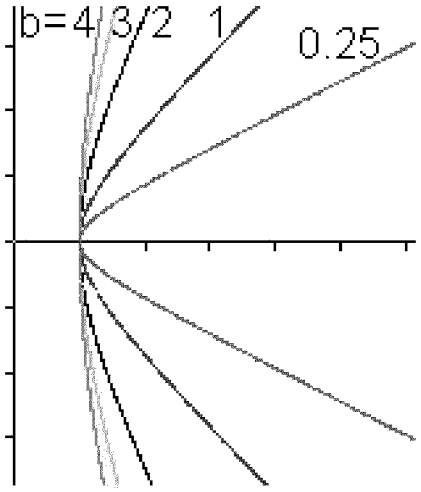
FIG. 6 shows examples of different curvatures of a hyperbolic function in dependence of variable b from formula (1).
Figure 7:
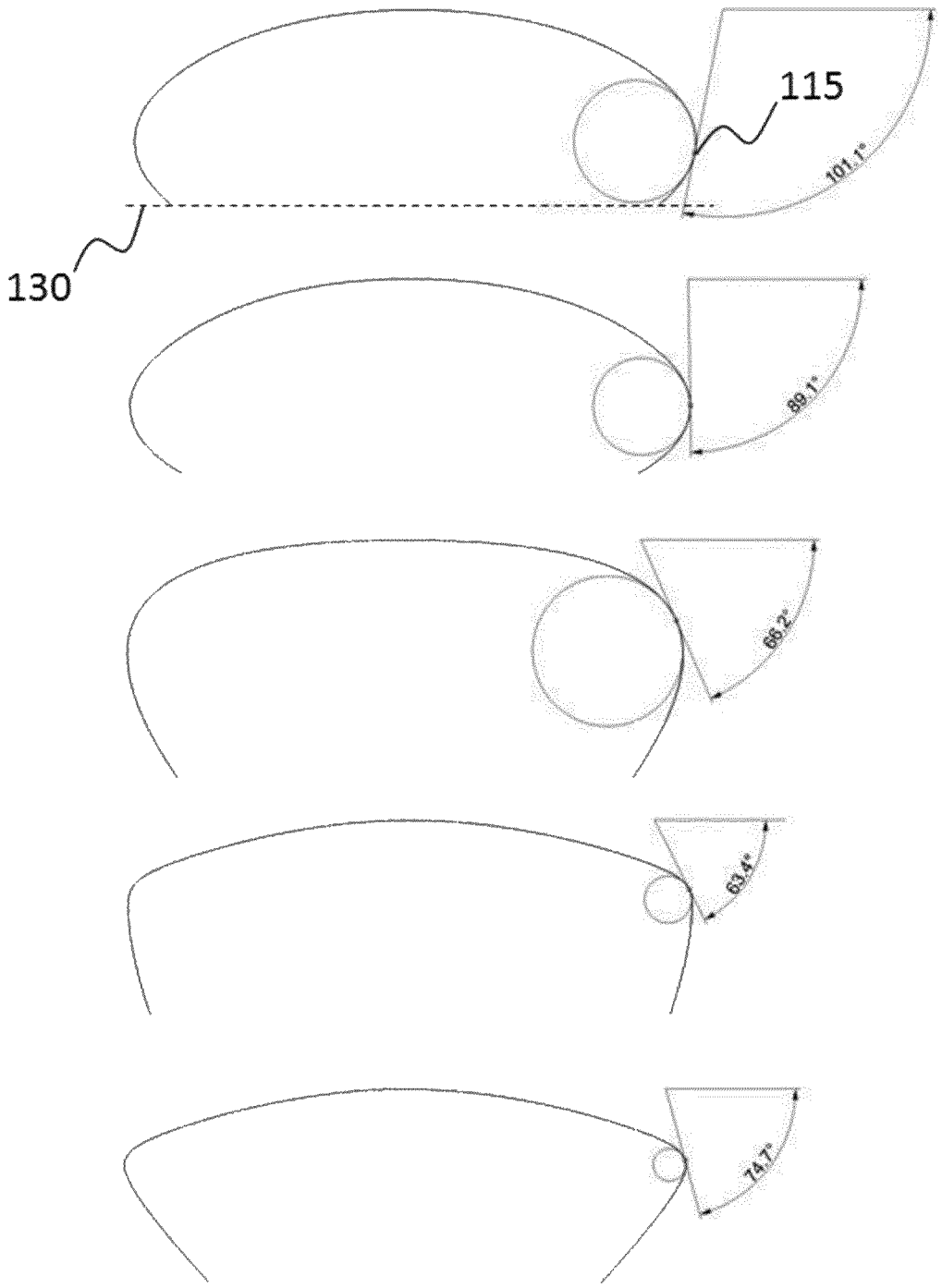
FIG. 7 shows a cross section of different embodiments with the downward curved surface of the foot support sections S (110) and S' (111) in the longitudinal extension direction (140) being defined by a hyperbolic function curve. The maximal inclination angle is measured at the vertex (115) of the hyperbolic function in relation to the support surface (130).
Figure 8:
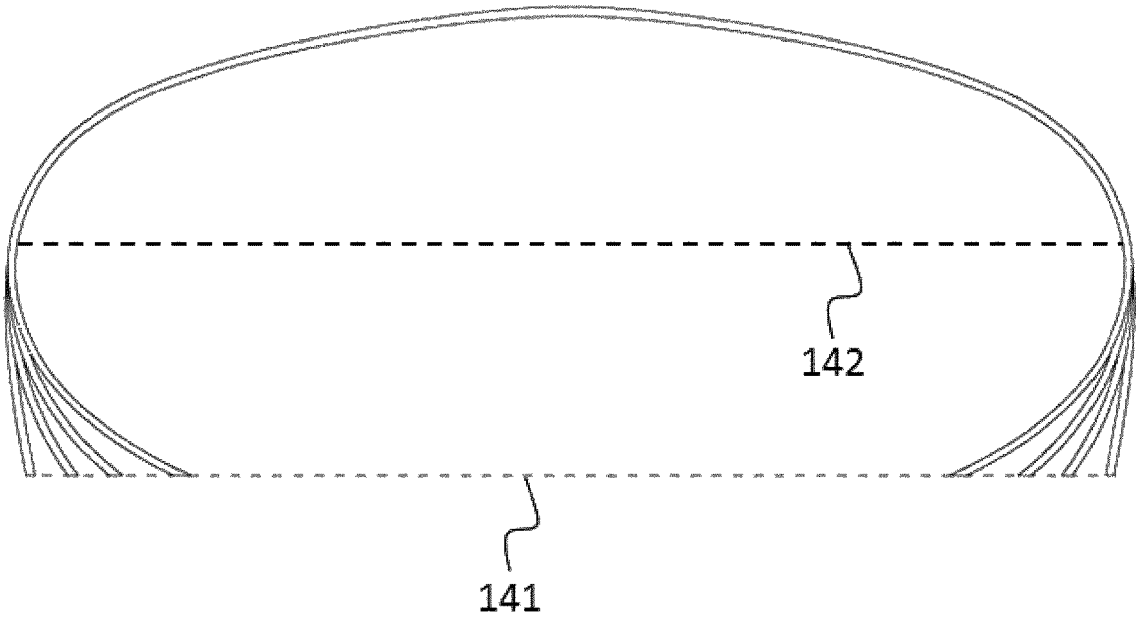
FIG. 8 shows different embodiments of the footrest with different curvatures of the base sections B (120) and B' (121) with the length (141) being shorter than the length (142).
Figure 9:
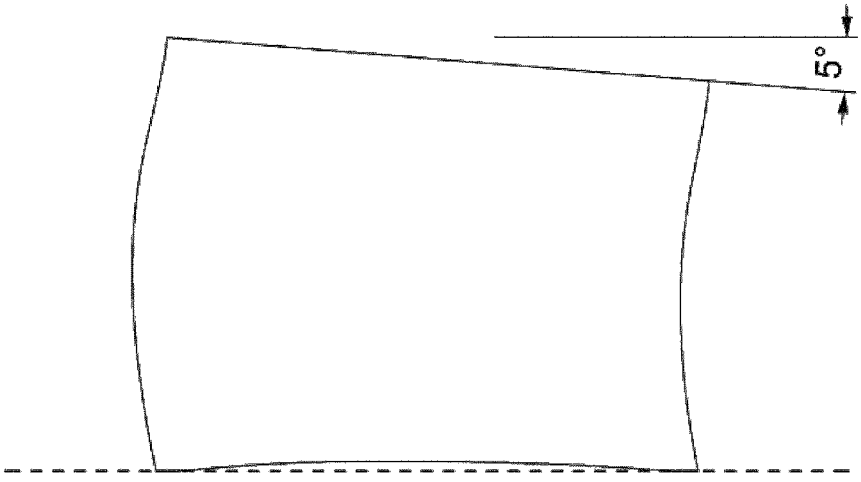
FIG. 9 shows the side view of an embodiment with a transverse inclination angle of 5°.
Figure 10:
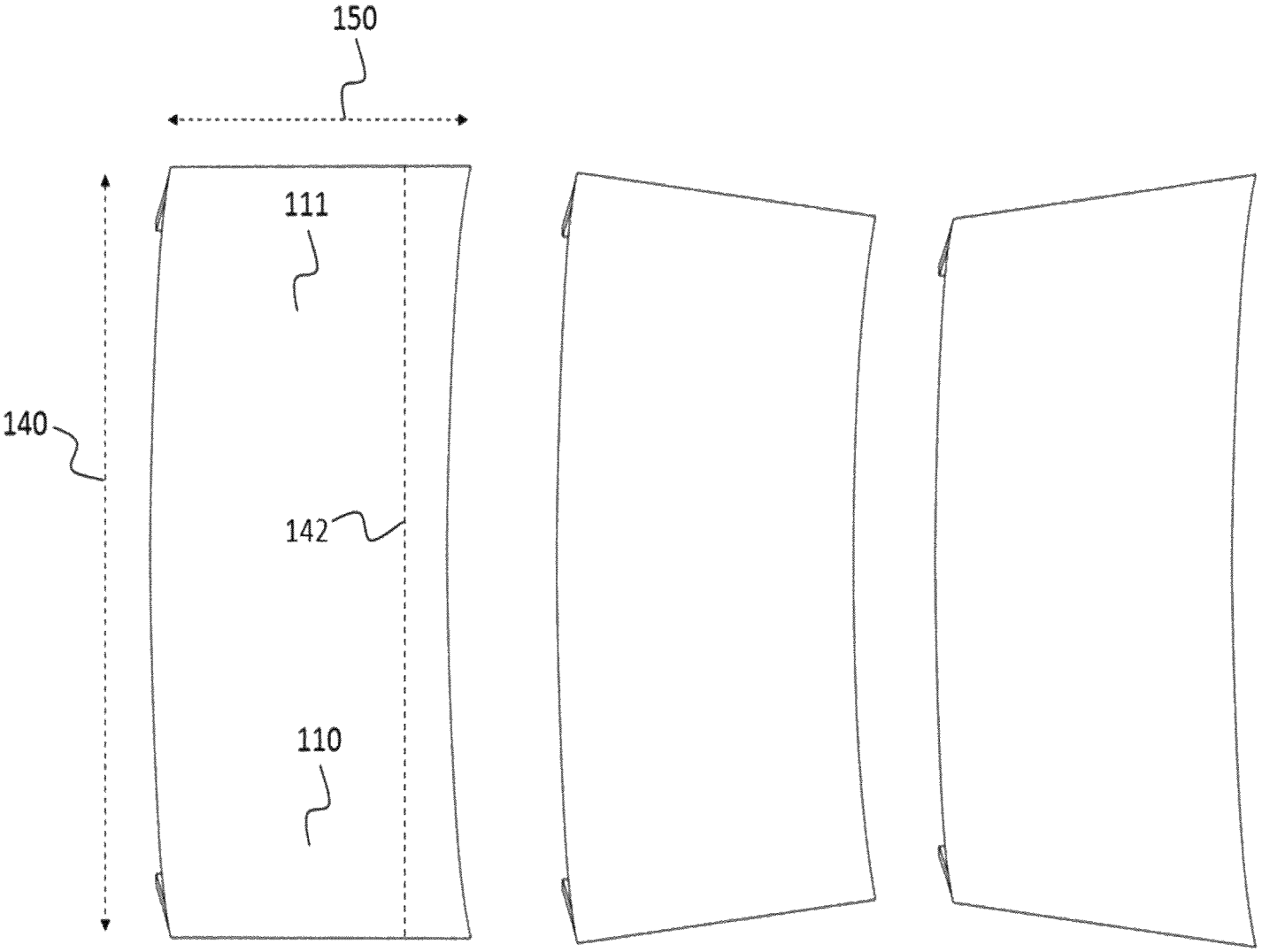
FIG. 10 shows the top view of three different embodiments of the invention. The outer surfaces of the foot support sections S (110) and S' (111) are curved in the transverse extension direction (150). The length (142) is not constant in certain embodiments along the transverse extension direction (150), with the length (142) decreasing from one side of the footrest to the other side in the transverse extension direction (150).
Figure 11:
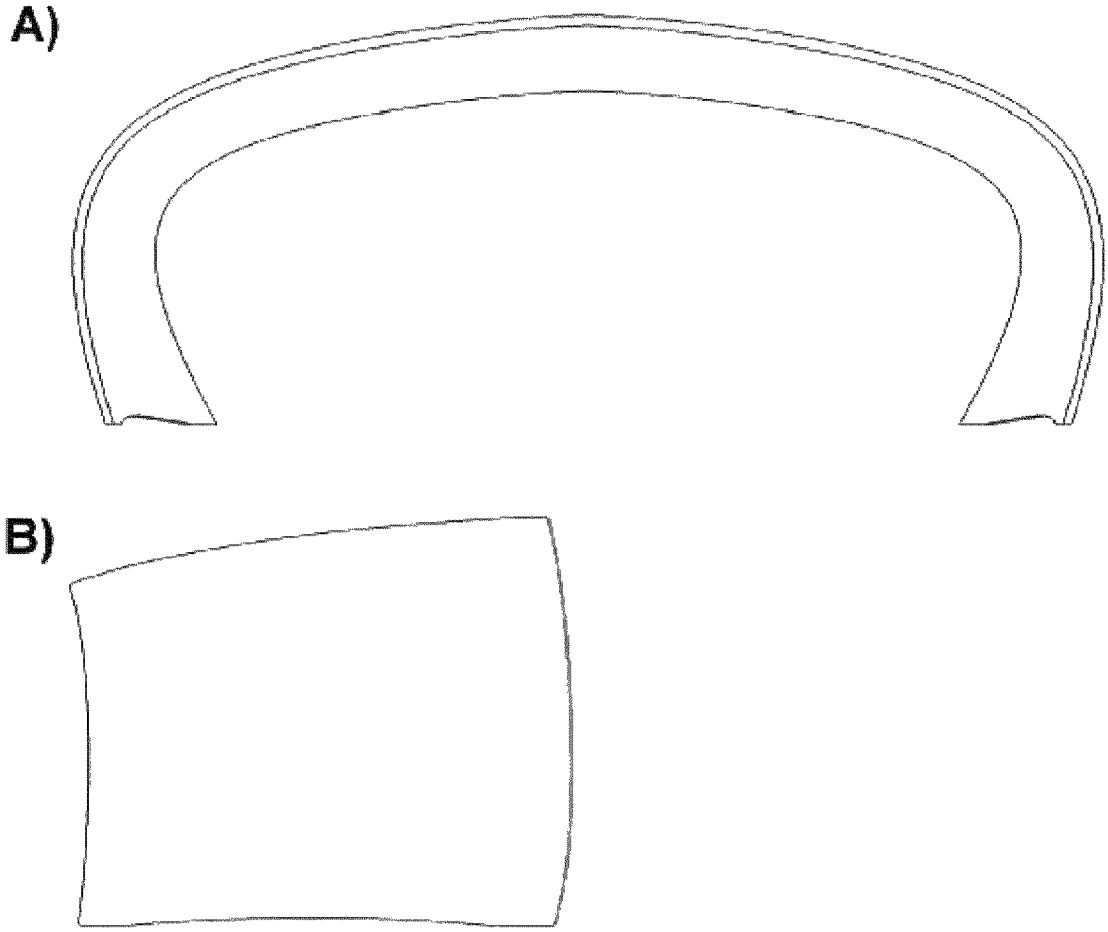
FIG. 11 shows an embodiment of the footrest (100) in A) frontal view and B) side view. The base sections (120, 121) of this embodiment are under normal conditions of use not in contact with the support surface (130) over the whole width of the base section, but only in two sections.
Figure 12:
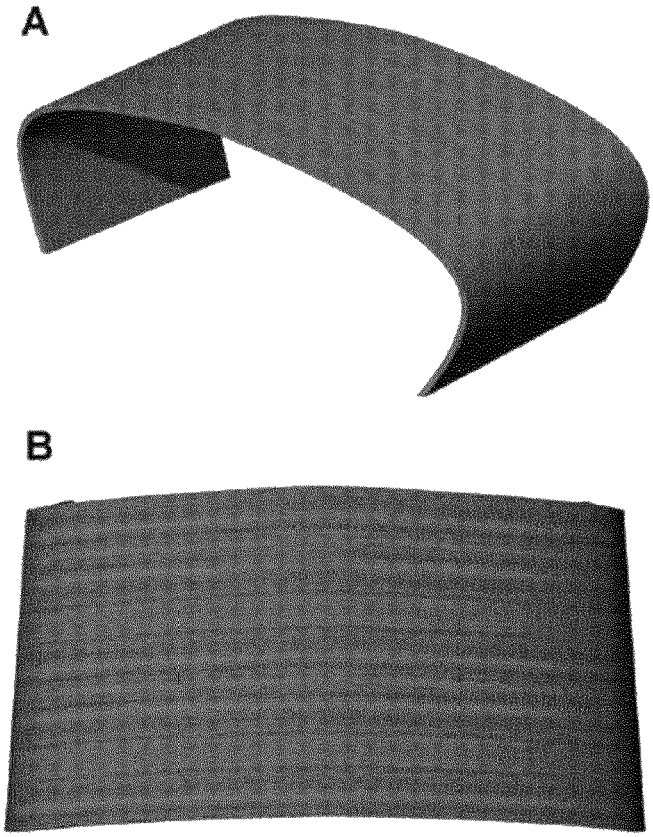
FIG. 12 shows an embodiment of the invention similar to the embodiment shown in FIG. 3 made of wood in A) a perspective view and B) top view.
Figure 13:
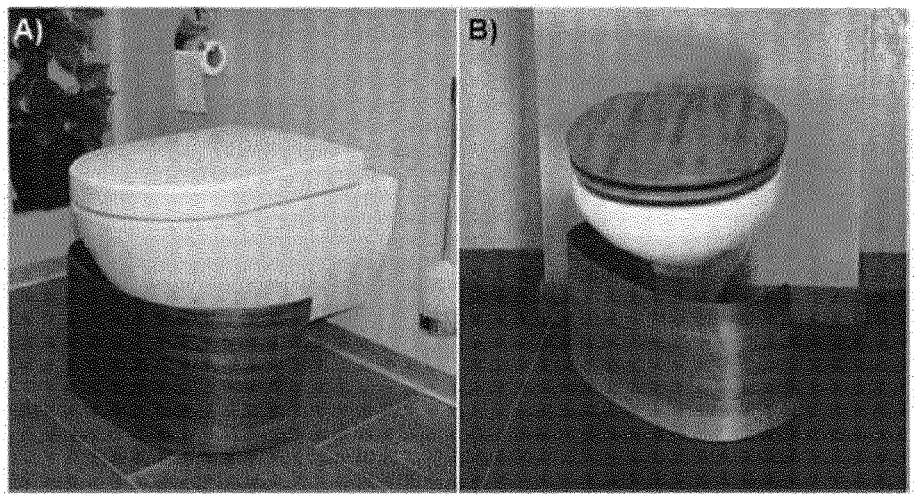
FIG. 13 shows an embodiment in the 90° tilted storage position around the base of a toilet seat. The footrest can be stored around A) the frontal base of the toilet seat or B) shifted to the side of the toilet base according to the space available.
Figure 14:
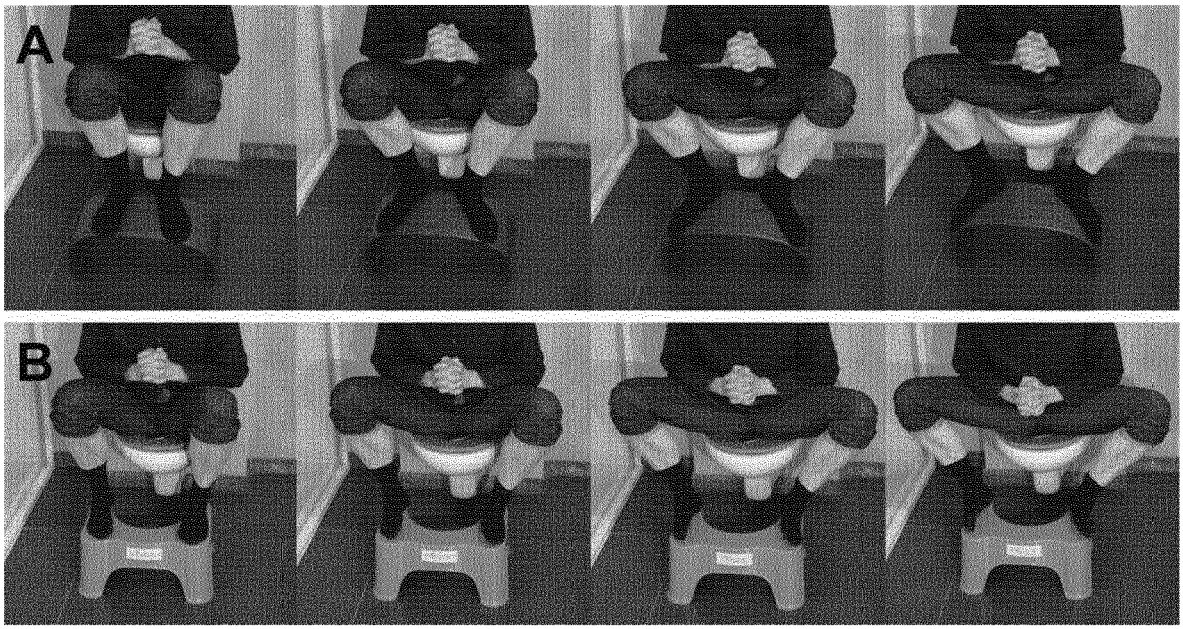
FIG. 14 shows the seating position and placement of the feet using A) an embodiment of the invention and B) a footrest known in the art. Even in positions with an increasing angle of spread thighs, the footrest of the invention allows the user to place the feet comfortable on the foot support sections with the whole sole of the feet being in contact with the surface. In contrast, the footrest according to the prior art does not allow to place the feet with the whole sole being in contact on the foot support surface or without unphysiologically bend ankles.
Figure 15:
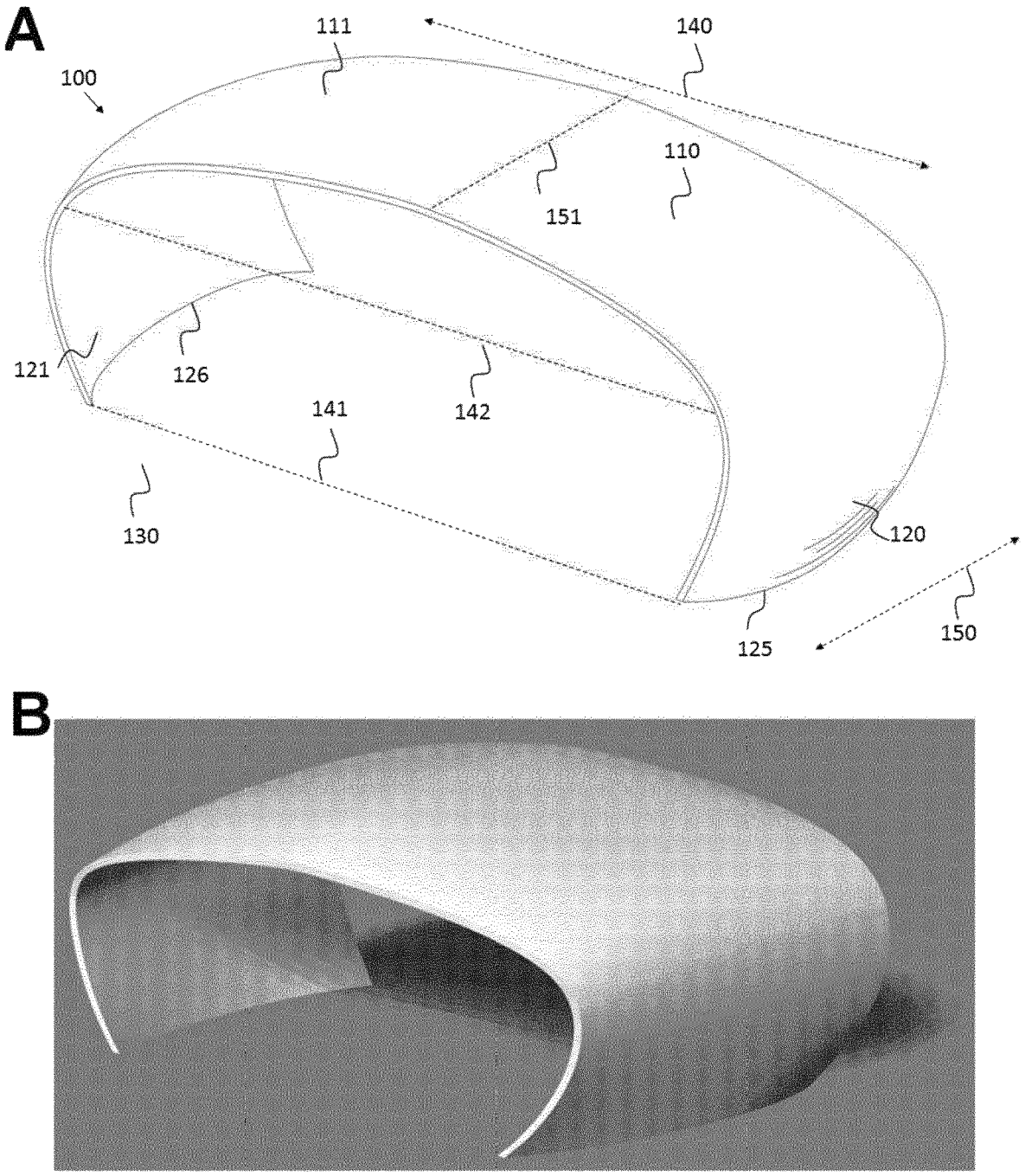
FIG. 15 shows an embodiment of the footrest (100) wherein the base sections are oval shaped, and the foot support sections are curved downwards in both directions of the transverse extension direction (150), with the highest point of the foot support section being in the geometric centre.
Figure 16:
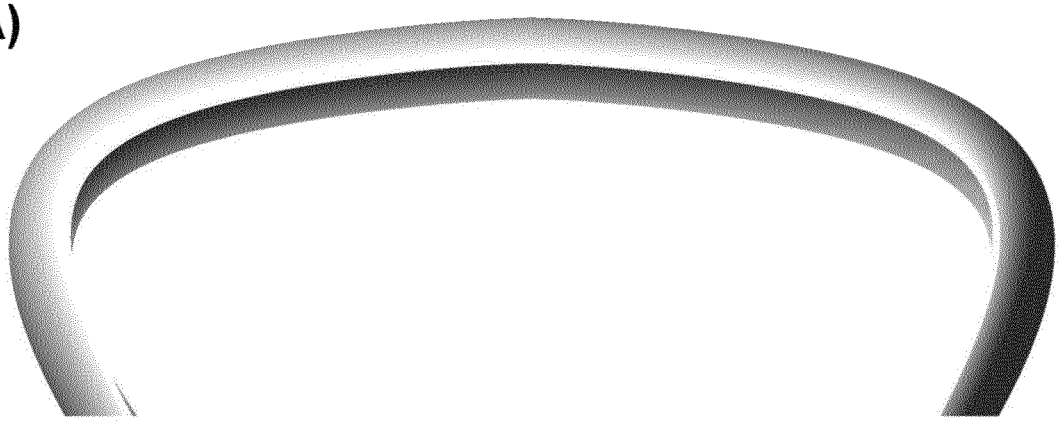
FIG. 16 shows an embodiment of the footrest in A) frontal view and B) side view. This embodiment has a length (141) that is smaller than a length at the end of said foot support sections (142) adjacent to said base sections. The footrest is also inclined as well as curved in the transverse extension direction (150).
Figure 16:
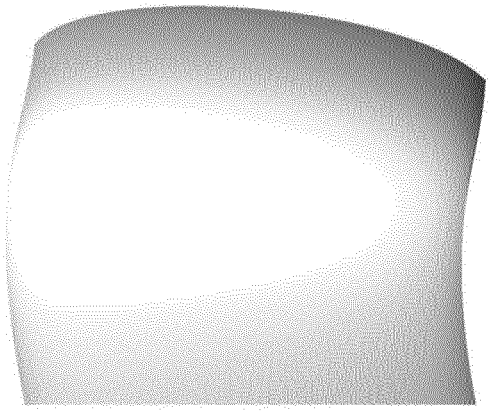
Figure 17:
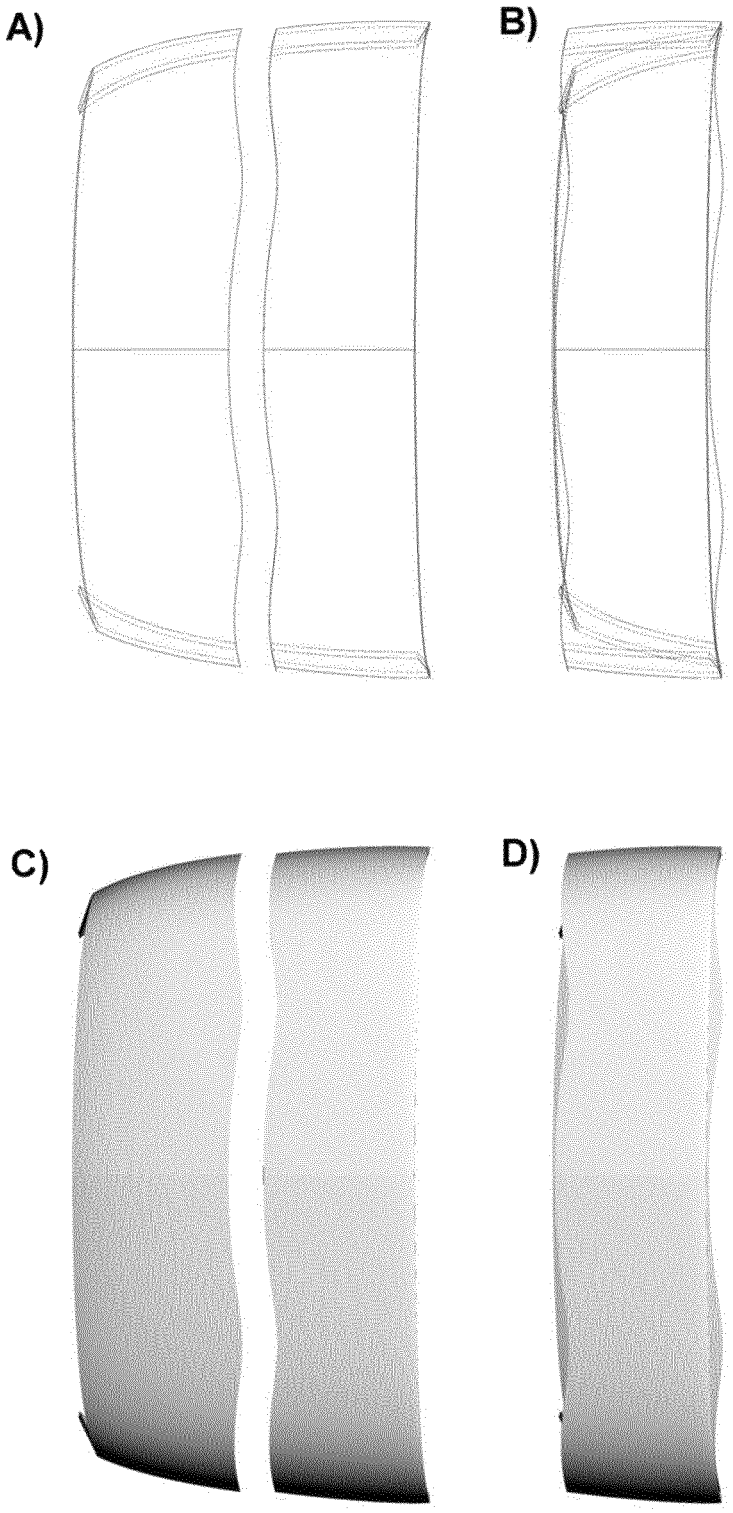
FIG. 17 shows an embodiment of a dividable footrest. In top view A), C) the undulating division line of the footrest is visible. The divided parts of the footrest can be stored within each other as shown in B) and D).
Figure 18:
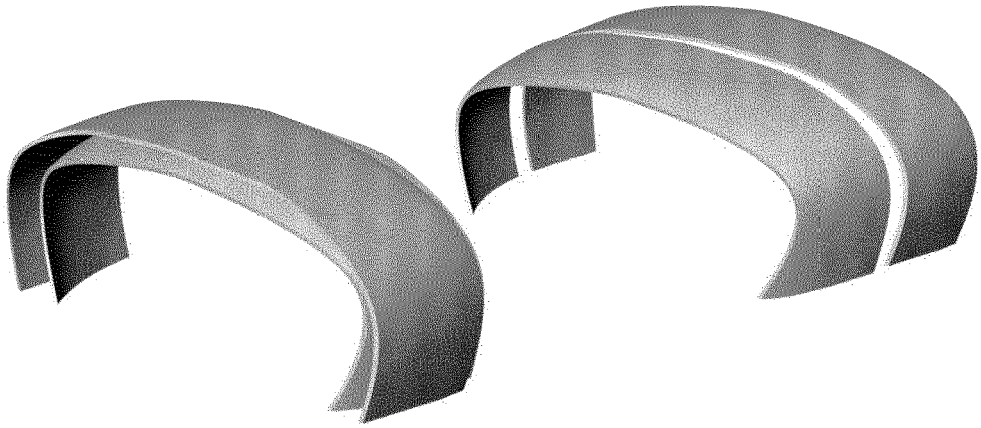
FIG. 18 shows an embodiment of a dividable footrest in perspective view. The divided parts of the footrest can be stored within each other.
Figure 19:
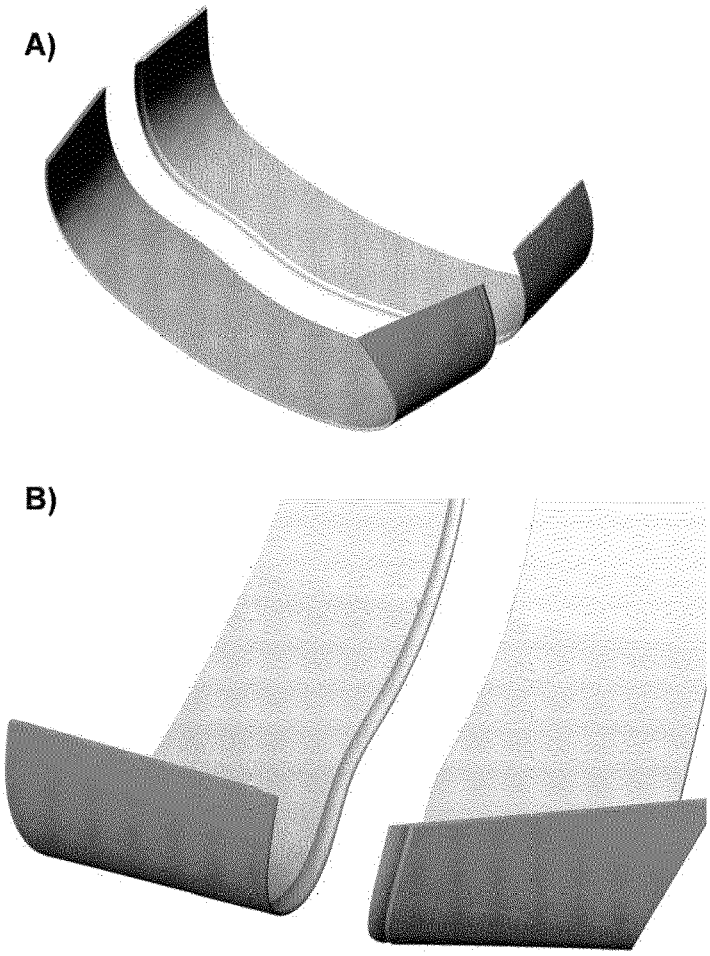
FIG. 19 shows an embodiment of a dividable footrest with a joining mechanism comprising an overlapping section of both parts that is thinner than the material of the corresponding section of the footrest with an undulating cross-section. The overlapping section of the joining mechanism has a thicker part at the ending of the overlapping section and a thinner part at the start of the overlapping section. The thinner and the ticker part of the overlapping section fit into each other and achieve form-closure once the divided parts of the footrest are joined.
Figure 20:
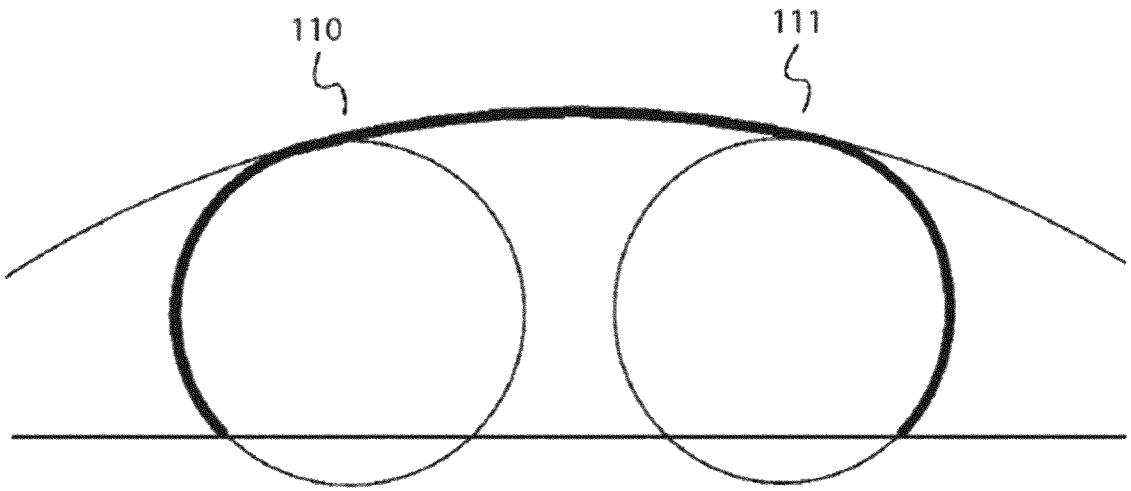

The invention claimed is:

1. A footrest designed to support a squatting position during seated-position toilet use comprising two base sections B and B' that are, under normal conditions of use, in contact with a supporting surface and two foot-support sections S and S' adjacent to said base sections characterized in that S and S' have an outer surface that is at least partially inclined downwards in the longitudinal extension direction towards said base sections B and B' wherein the longitudinal extension direction runs from the base section B towards foot support sections S and S' and then towards base section B', wherein the downwards inclined outer surfaces of foot-support sections S and S' are curved downwards in the longitudinal extension direction towards said base sections B and B'.

2. The footrest according to claim 1, wherein the outer surface of foot-support sections S and S' are entirely inclined downwards in the longitudinal extension direction towards said base sections B and B'.

3. The footrest according to claim 1, wherein the downwards inclined surface of the foot-support sections S and S' have independently from each other in the longitudinal extension direction towards the base sections B or B' a maximal longitudinal inclination angle that is between 5° and 20°.

4. The footrest according to claim 1, wherein the downwards inclined surface of the foot-support sections S and S' have independently from each other in the longitudinal extension direction towards the base sections B or B' a maximal longitudinal inclination angle that is between 8° and 16°.

5. The footrest according to claim 4, wherein the maximal curvature of the downwards curved outer surfaces of foot-support sections S and S' in the longitudinal extension direction is characterized by an osculating circle with a radius of 0.1 cm to 12 cm.

6. The footrest according to claim 4, wherein the downwards curved outer surfaces of foot-support sections S and S' in a longitudinal extension direction towards the base sections B or B' are independently of each other defined by osculating circles with a decreasing radius with the smallest radius being at the transition from the foot support sections S and S' to the base sections B or B'.

7. The footrest according to claim 4, wherein the downwards curved surface of the foot-support sections S and S' in a longitudinal extension direction towards the base sections B or B' is independently from each other defined by a hyperbolic function curve.

8. The footrest according to claim 1, having in the transverse extension direction a maximal transverse inclination angle of up to 10°.

9. The footrest according to claim 1, having a length at the end of the base sections that are under normal conditions of use in contact with a supporting surface that is shorter than a length at the end of said foot support sections adjacent to said base sections.

10. The footrest according to claim 1, wherein the base sections B and B' have an outer surface that is curved in the transverse extension direction.

11. The footrest according to claim 1, wherein the end of the base sections that are under normal conditions of use in contact with a supporting surface have a width smaller than the maximal width of said footrest.

12. The footrest according to claim 1, wherein under normal conditions of use the end of the base sections are not in contact with the support surface over the whole width of the base section, but only in two or three sections.

13. The footrest according to claim 1, wherein said footrest is in a two-part form, wherein the two parts are detachably connected along a division line in the longitudinal extension direction.

14. A method for using the footrest according to claim 1, comprising:

supporting a subject in a squatting position during seated-position toilet use.

15. The footrest according to claim 4, wherein the maximal curvature of the downwards curved outer surfaces of foot-support sections S and S' in the longitudinal extension direction is characterized by an osculating circle with a radius of 1 cm to 8 cm.

16. The footrest according to claim 4, wherein the maximal curvature of the downwards curved outer surfaces of foot-support sections S and S' in the longitudinal extension direction is characterized by an osculating circle with a radius of 2 cm to 7 cm.

17. The footrest according to claim 1, having in the transverse extension direction a maximal transverse inclination angle of 3° to 10°.

18. The footrest according to claim 1, having in the transverse extension direction a maximal transverse inclination angle of 5° to 8°.

19. The footrest according to claim 1, wherein under normal conditions of use the end of the base sections are not in contact with the support surface over the whole width of the base section, but only in two sections.

* * * * *